US006935962B1

(12) United States Patent
Tseng

(10) Patent No.: US 6,935,962 B1
(45) Date of Patent: Aug. 30, 2005

(54) SWING WITH AN EXTENSION FRAME

(75) Inventor: Chuen-Jong Tseng, Chiayi Hsien (TW)

(73) Assignee: Taiwan Shin Yeh Enterprise Co., Ltd., Chaiyi Hsien (TW)

( * ) Notice: Subject to any disclaimer, the term of this patent is extended or adjusted under 35 U.S.C. 154(b) by 0 days.

(21) Appl. No.: 10/924,162

(22) Filed: Aug. 23, 2004

(51) Int. Cl.[7] ..... A63G 9/00
(52) U.S. Cl. ..... 472/125; 297/423.2
(58) Field of Search ..... 472/118–125; 297/68, 423.2

(56) References Cited

U.S. PATENT DOCUMENTS 512,204 A * 1/1894 Miles ..... 297/313
1,125,167 A * 1/1915 Pepper ..... 297/320
1,984,281 A * 12/1934 Poggendorf ..... 297/317
2,480,300 A * 8/1949 Luketa ..... 297/423.2
3,295,885 A * 1/1967 Barksdale ..... 297/84
4,364,603 A * 12/1982 Johnson ..... 297/84
5,882,083 A * 3/1999 Robinson ..... 297/440.2
6,145,931 A * 11/2000 Subotic ..... 297/423.2
6,348,005 B1 * 2/2002 Tseng ..... 472/118
6,648,768 B1 * 11/2003 Tseng ..... 472/118
6,802,783 B1 * 10/2004 Tseng ..... 472/118
6,827,650 B1 * 12/2004 Tseng ..... 472/125

* cited by examiner

*Primary Examiner*—Kien Nguyen
(74) *Attorney, Agent, or Firm*—Ladas & Parry LLP

(57) ABSTRACT

A swing frame unit of a swing includes a supporting frame, a seat frame disposed on the supporting frame, a backrest frame pivoted to the supporting frame and pivotable between a horizontal position and an inclined position, and an extension frame mounted movably on the supporting frame and movable in a transverse direction relative to the supporting frame from a retracted position to an extended position, in which the extension frame extends outwardly of the supporting frame in the transverse direction so as to increase an overall length of the backrest frame, the seat frame, and the extension frame in the transverse direction.

3 Claims, 9 Drawing Sheets

SWING WITH AN EXTENSION FRAME

BACKGROUND OF THE INVENTION

1. Field of the Invention

This invention relates to a swing, more particularly to a swing with an extension frame.

2. Description of the Related Art

FIGS. 1 and 2 illustrate a conventional swing 1 that includes a swing-supporting unit 11, and a swing frame unit 12 mounted swingably on the swing-supporting unit 11. The swing frame unit 12 includes a supporting frame 122, a U-shaped seat frame 131 disposed on the supporting frame 122, a U-shaped backrest frame 132 connected pivotally to the seat frame 131 and pivoted to the supporting frame 122 so as to be pivotable between a horizontal position and an inclined position relative to the seat frame 131, a pair of retaining members 141 secured to a rear side of the supporting frame 122, and a U-shaped supporting leg 143 pivoted to the backrest frame 132. The U-shaped supporting leg 143 engages relesably the retaining members 141 for retaining the backrest frame 132 at the inclined position, and is adapted to contact the ground surface when disengaged from the retaining members 141 to dispose the backrest frame 132 at the horizontal position.

The conventional swing 1 is disadvantageous in that the overall length of the backrest frame 132 and the seat frame 131 in a transverse direction relative to a front side of the supporting frame 122 when the backrest frame 132 is disposed at the horizontal position is relatively short and is not suitable for the user to lie down.

SUMMARY OF THE INVENTION

Therefore, the object of the present invention is to provide a swing with an extension frame that is capable of overcoming the aforementioned drawback of the prior art.

According to the present invention, there is provided a swing that comprises a swing-supporting unit and a swing frame unit supported swingably on the swing-supporting unit. The swing frame unit includes: a supporting frame having a front edge and a bottom side; a seat frame disposed on the supporting frame; a backrest frame pivoted to the supporting frame and pivotable about an axis between a horizontal position and an inclined position relative to the seat frame; and an extension frame mounted movably on the bottom side of the supporting frame and movable in a transverse direction relative to the front edge of the supporting frame from a retracted position to an extended position, in which the extension frame extends outwardly of the front edge of the supporting frame in the transverse direction so as to increase an overall length of the backrest frame, the seat frame, and the extension frame in the transverse direction.

BRIEF DESCRIPTION OF THE DRAWINGS

In drawings which illustrate embodiments of the invention.

DETAILED DESCRIPTION OF THE PREFERRED EMBODIMENTS

Figure 1:
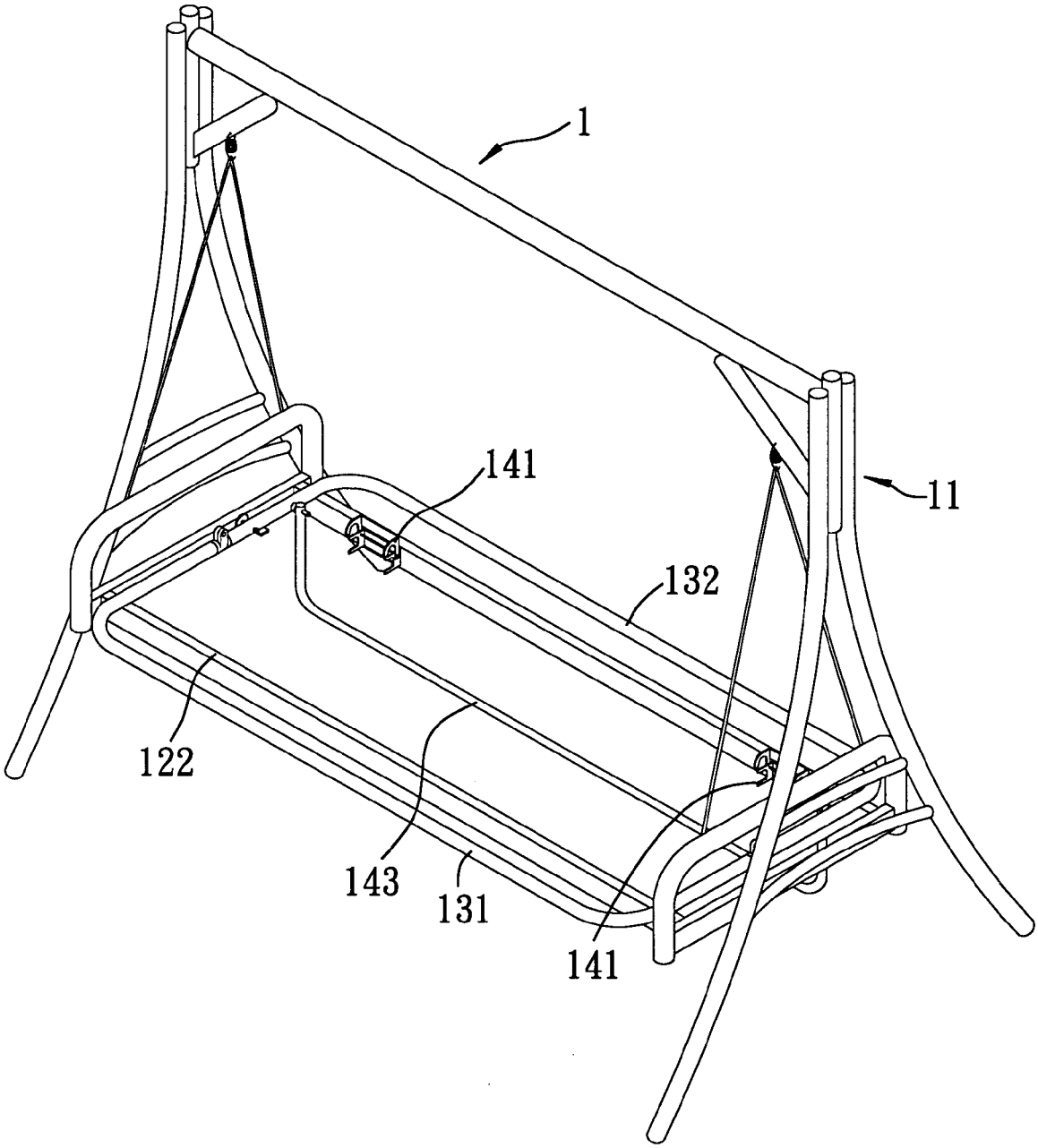
FIG. 1 PRIOR ART
FIG. 1 is a perspective view of a conventional swing.
Figure 2:
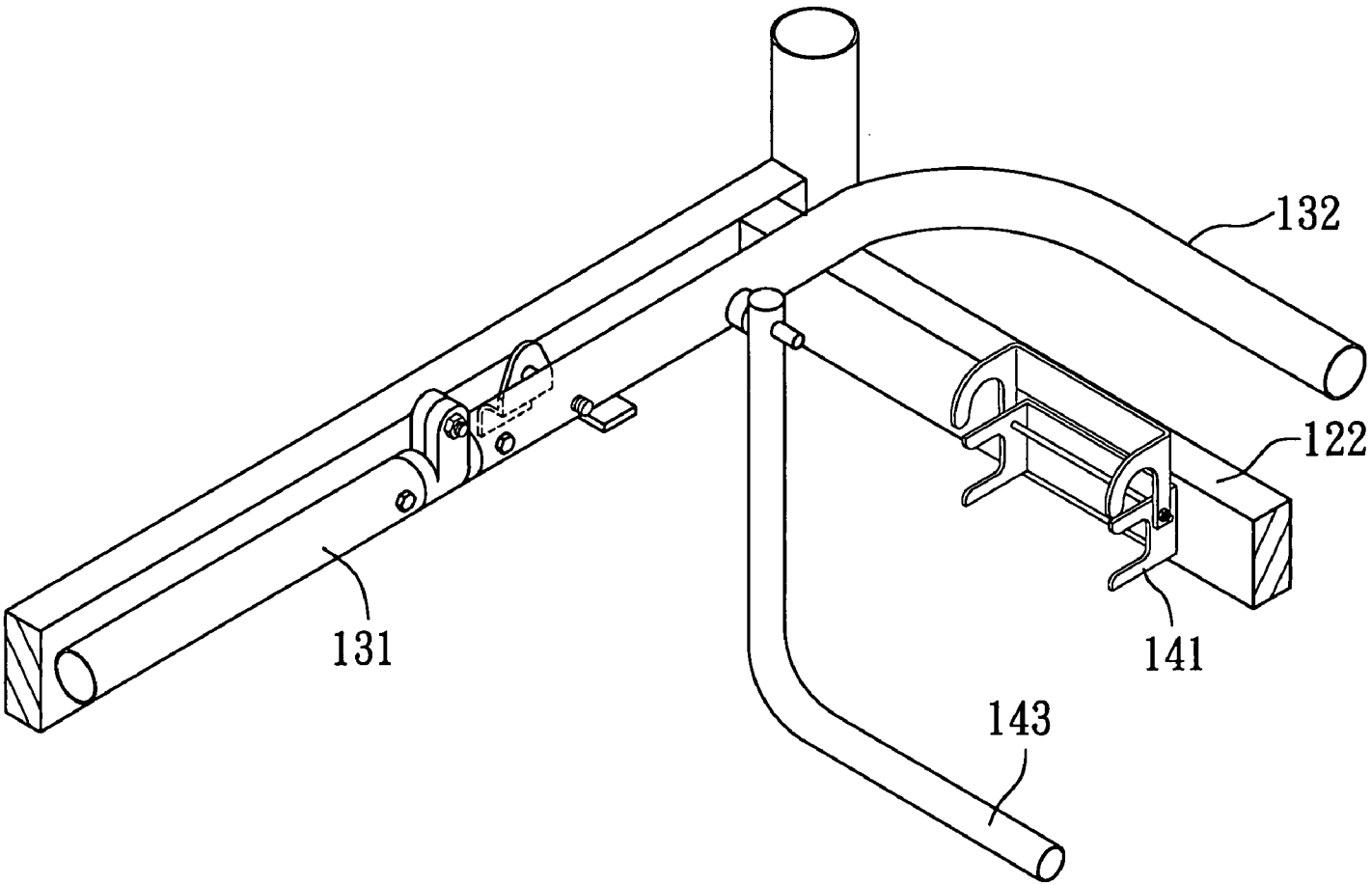
FIG. 2 PRIOR ART
FIG. 2 is a fragmentary perspective view of the conventional swing.
Figure 3:
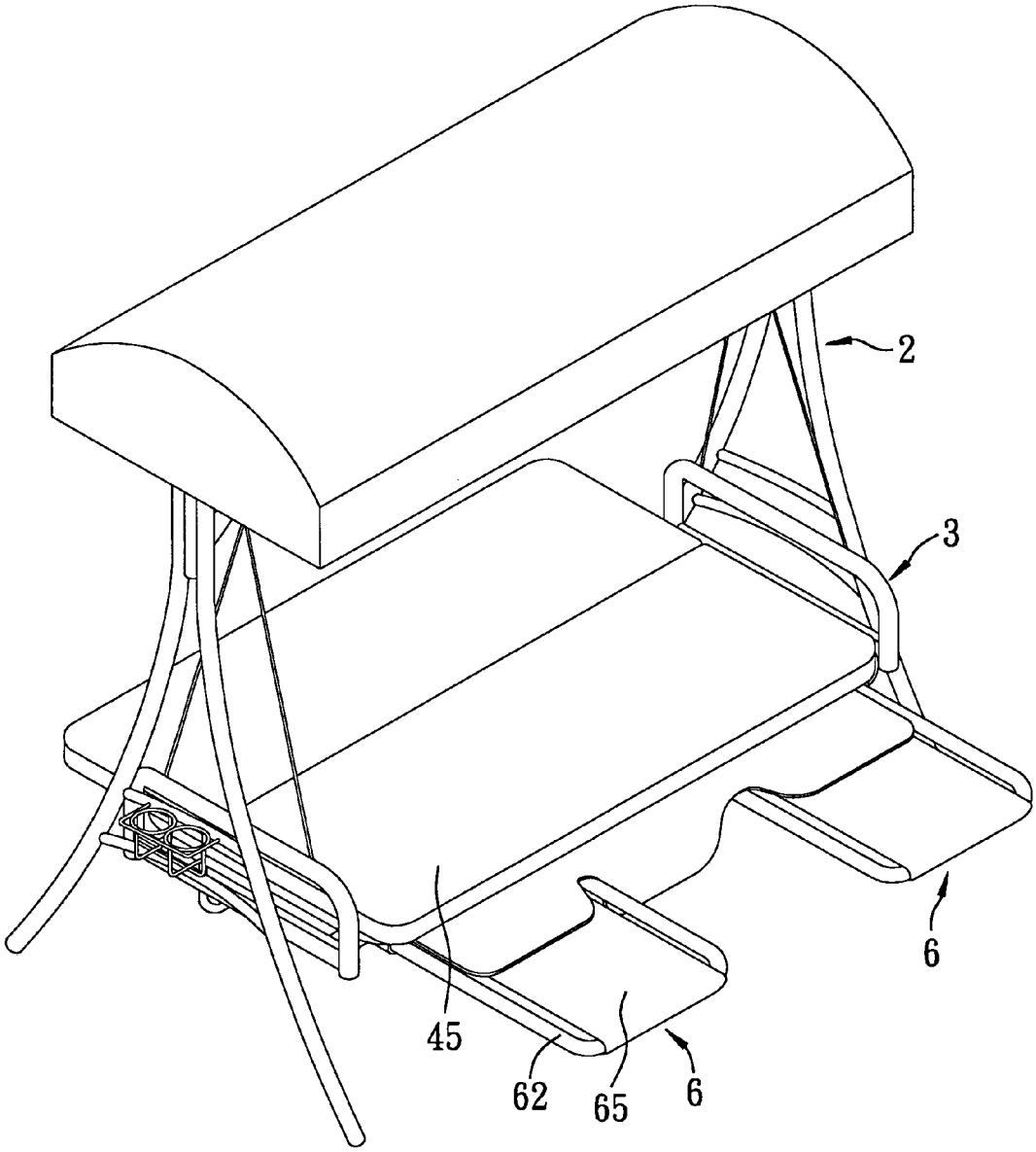
FIG. 3 is a perspective view of the first preferred embodiment of a swing according to this invention.
Figure 4:
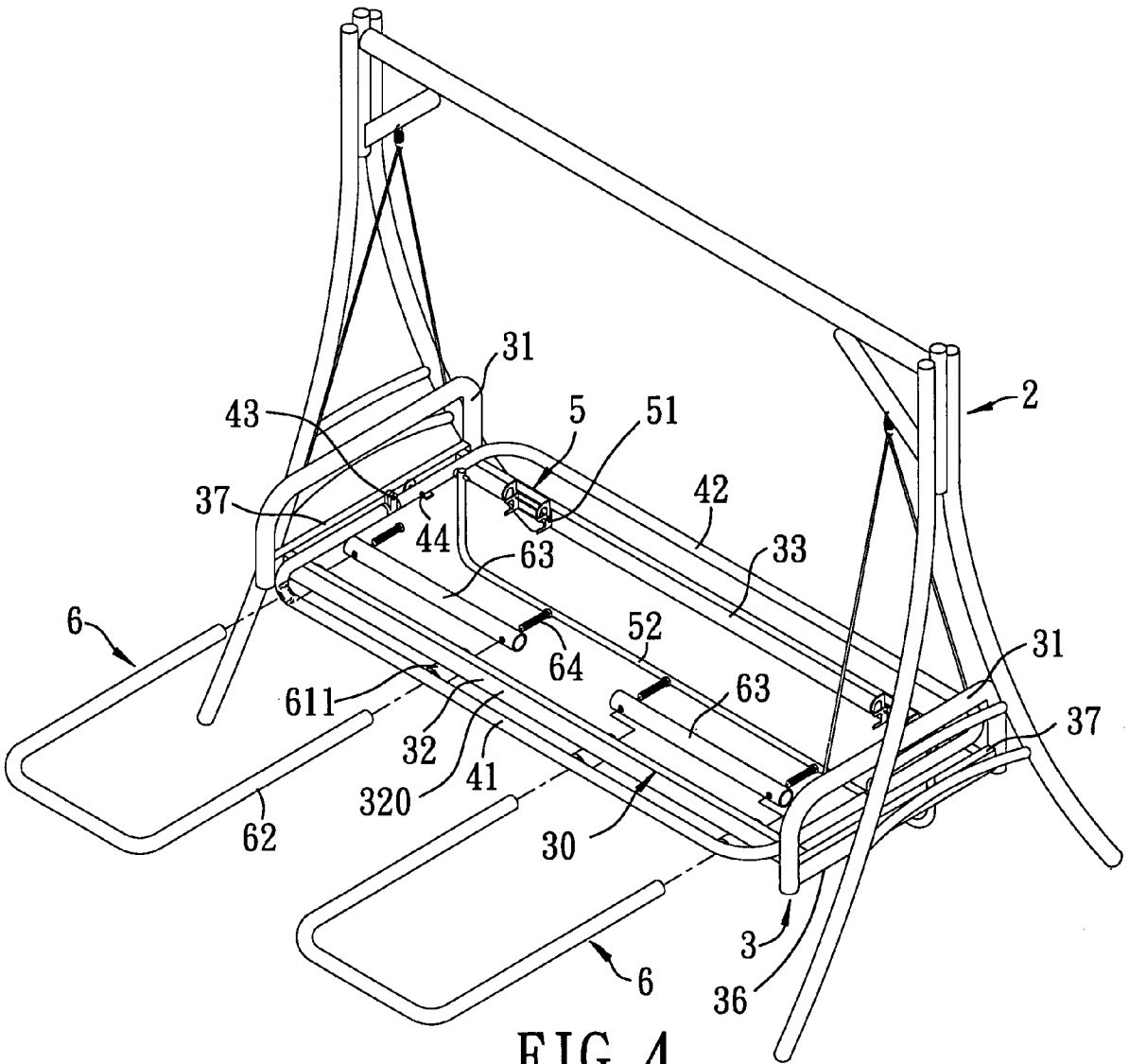
FIG. 4 is a partly exploded perspective view of the first preferred embodiment.
Figure 5:
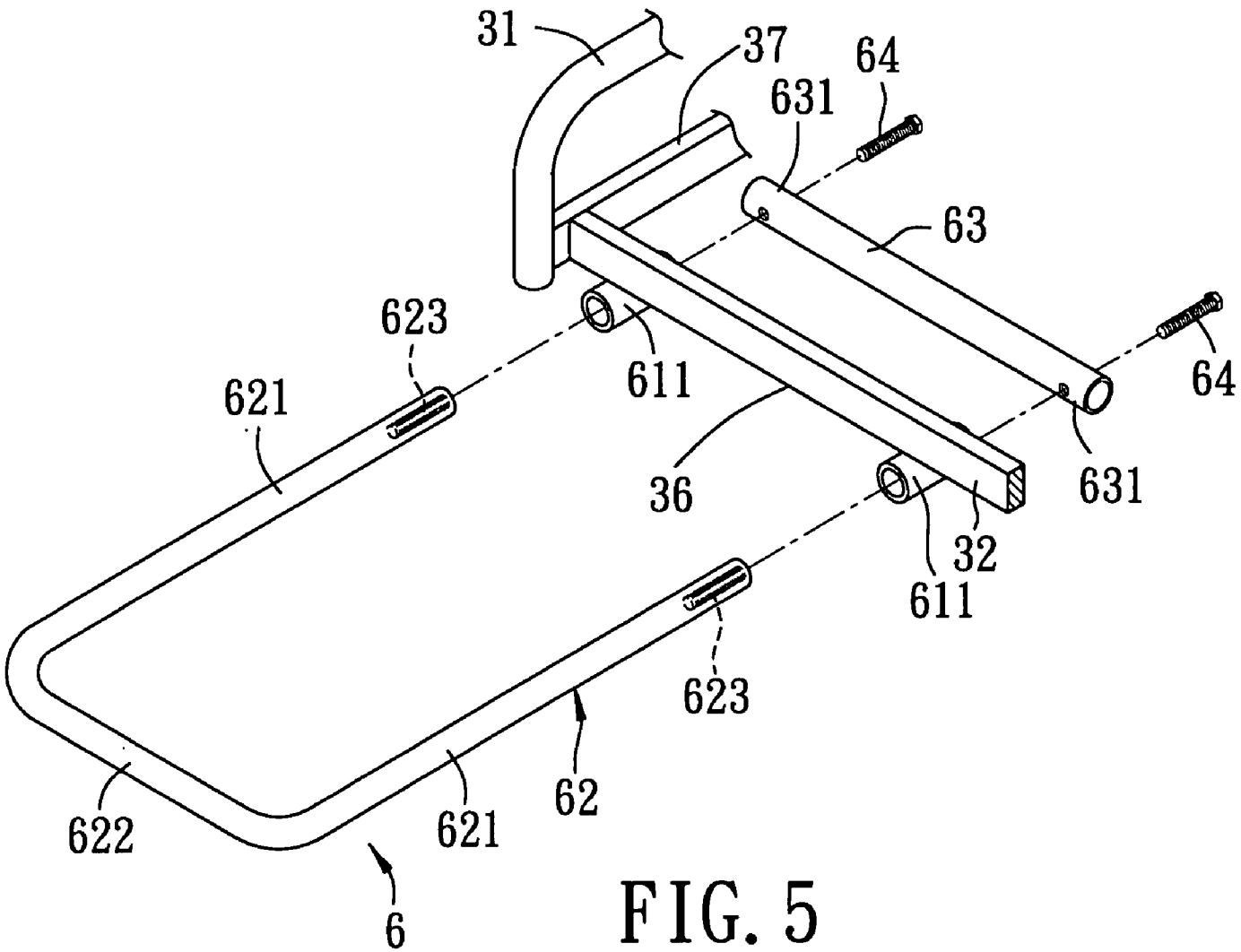
FIG. 5 is a fragmentary, partly exploded perspective view of the first preferred embodiment.
Figure 6:
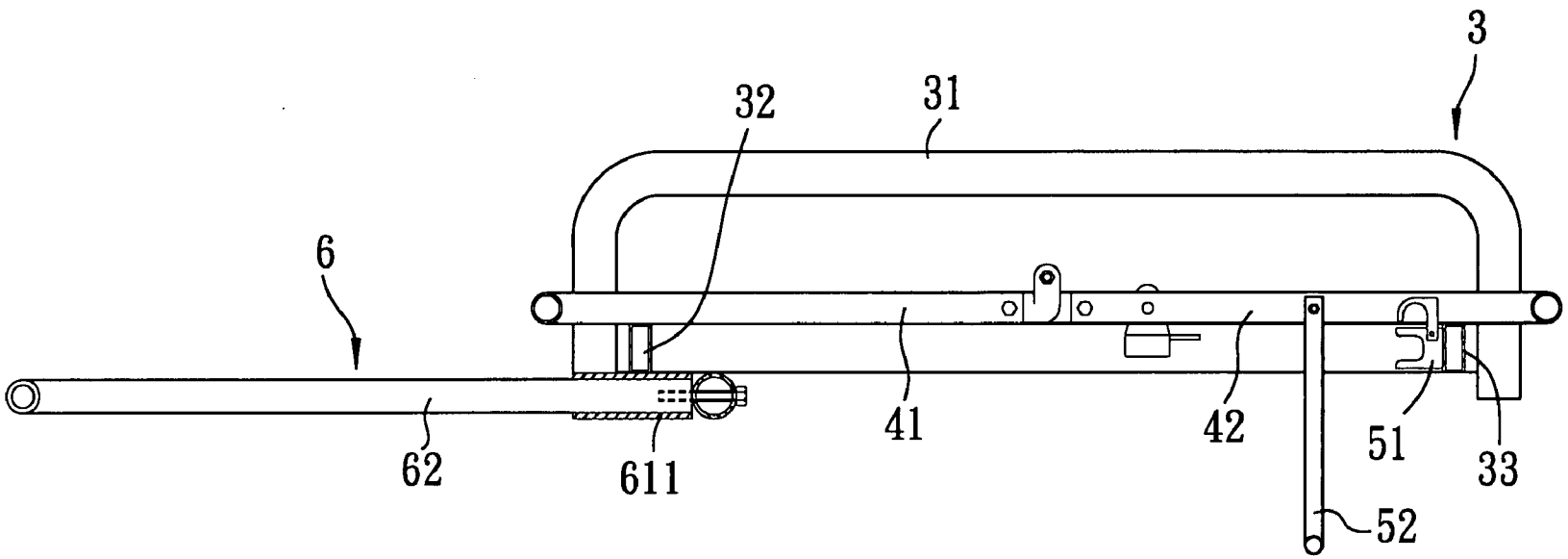
FIG. 6 is a fragmentary, partly sectional view of the first preferred embodiment.
Figure 7:
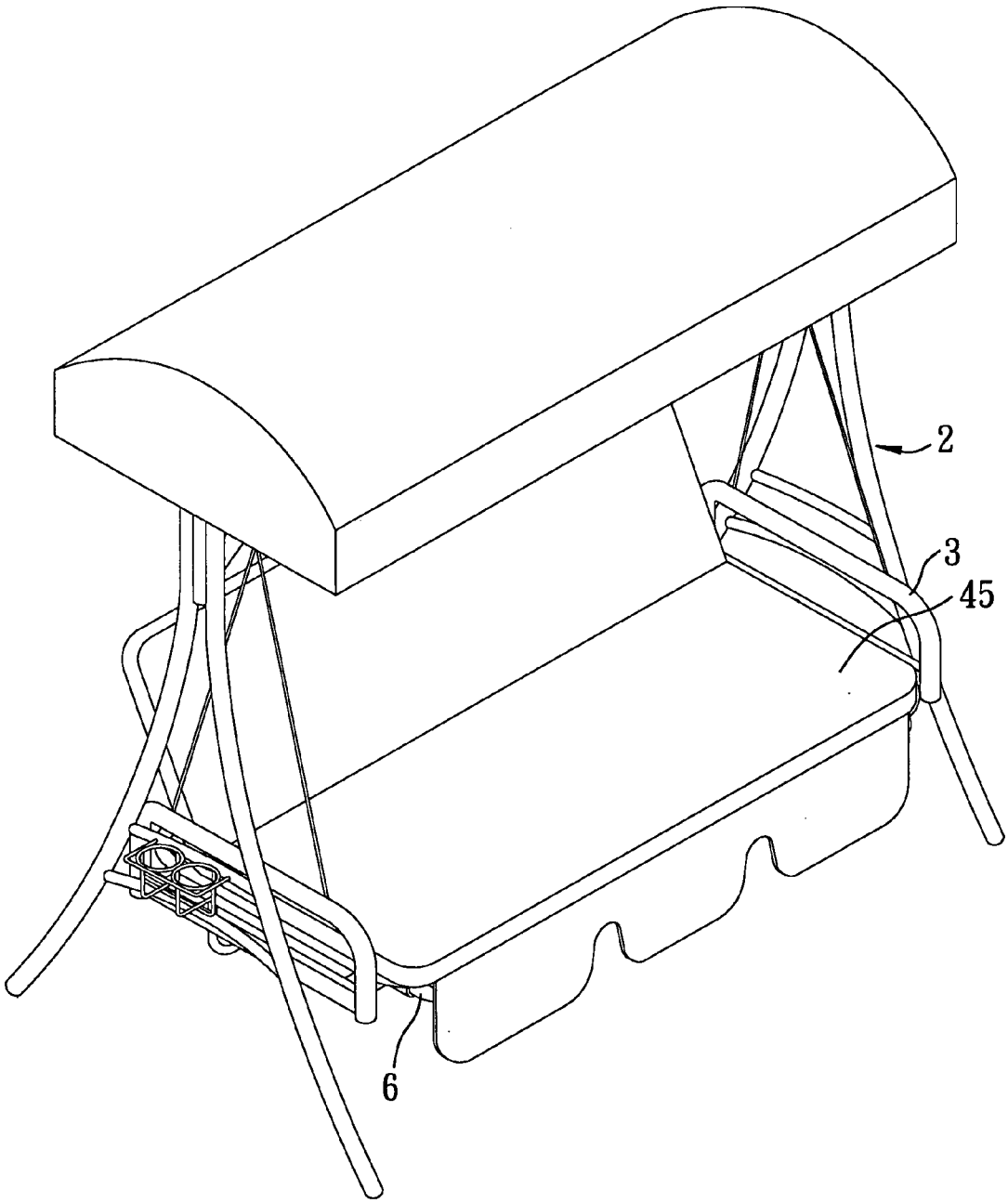
FIG. 7 is a perspective view of the first preferred embodiment in a state where a backrest frame is disposed at an inclined position and an extension frame is disposed at a retracted position.
Figure 8:
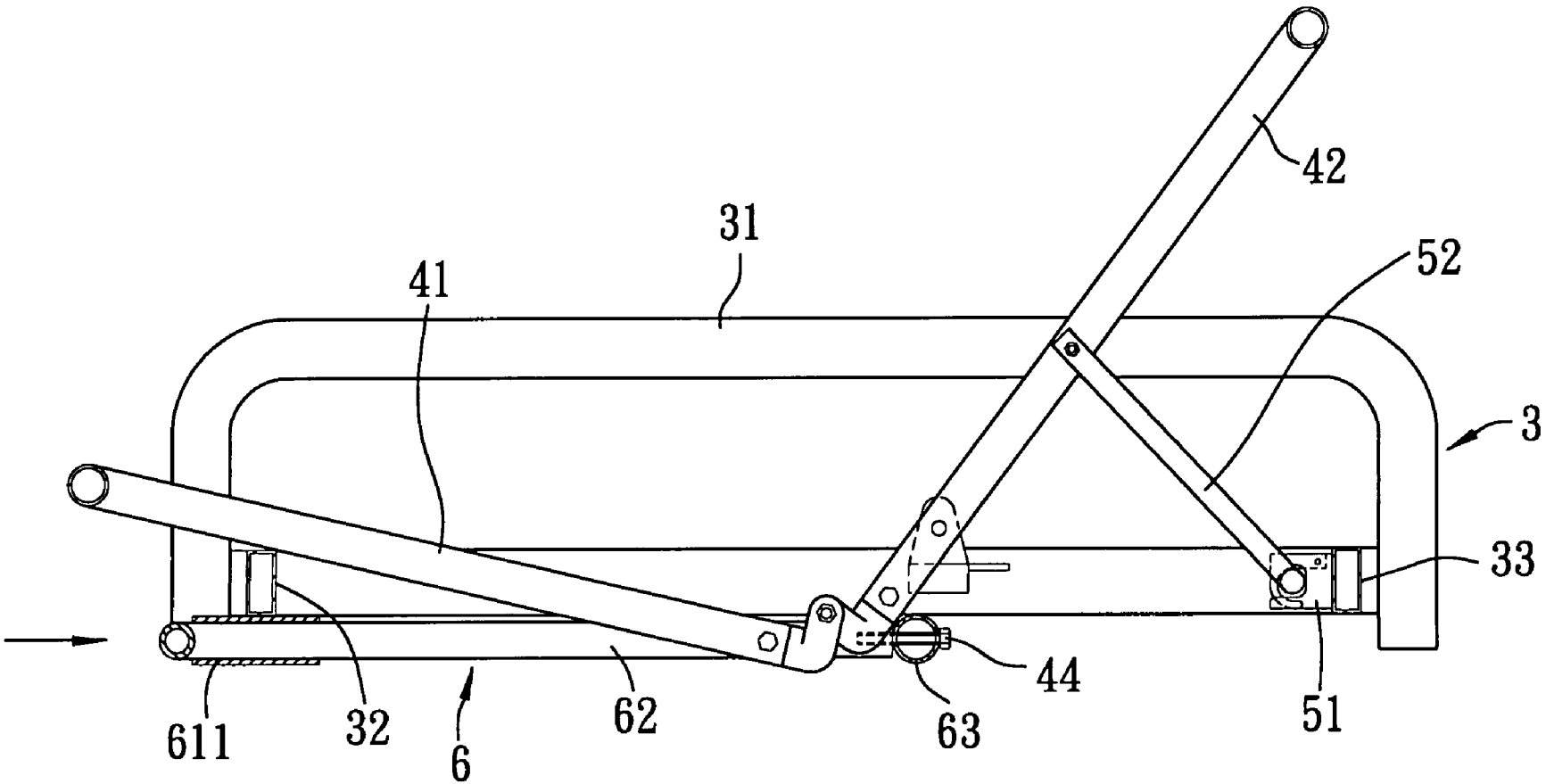
FIG. 8 is a fragmentary, partly sectional view of the first preferred embodiment in the state shown in FIG. 7.

Before the present invention is described in greater detail, it should be noted that same reference numerals have been used to denote like elements throughout the specification.

FIGS. 3 to 8 illustrate the first preferred embodiment of a swing according to this invention. The swing includes a swing-supporting unit 2 and a swing frame unit 3 supported swingably on the swing-supporting unit 2.

The swing frame unit 3 includes: a supporting frame 30 having a front edge 320 and a bottom side 36; a seat frame 41 disposed on the supporting frame 30; a backrest frame 42 pivoted to the supporting frame 30 through a pair of pivot pins 44 so as to be pivotable about an axis between a horizontal position (see FIG. 3) and an inclined position (see FIGS. 7 and 8) relative to the seat frame 41, the backrest frame 42 being further connected pivotally to the seat frame 41 through a pair of pivot joints 43; and two extension frames 6 mounted movably on the bottom side 36 of the supporting frame 30 and movable in a transverse direction relative to the front edge 320 of the supporting frame 30 from a retracted position (see FIG. 3) to an extended position (see FIGS. 7 and 8), in which the extension frames 6 extend outwardly of the front edge 320 of the supporting frame 30 in the transverse direction so as to increase an overall length of the backrest frame 42, the seat frame 41, and the extension frames 6 in the transverse direction. A cushion 45 is mounted on the seat frame 42 and the backrest frame 42.

In this embodiment, the supporting frame 30 includes an elongated front rod 32, a rear rod 33 opposite to the front rod 32, and two side rods 37 connected to the front and rear rods 32, 33. A pair of armrests 31 stand upright from the side rods 37, respectively. The front rod 32 defines the front edge 320 of the supporting frame 30, and is formed with two pairs of holding tubes 611 at the bottom side 36 of the supporting frame 30. The holding tubes 611 extend in the transverse direction. Each of the extension frames 6 includes a U-shaped rod 62 that has two opposite end portions 621 extending respectively through two corresponding ones of the holding tubes 611 in the transverse direction so as to be mounted movably on the supporting frame 30.

The swing frame unit 3 further includes a pair of extension-mounting units 5, each of which has a pair of bolts 64 and a stopping bar 63 disposed rearwardly of two corresponding ones of the holding tubes 611 and having two opposite end portions 631 which are aligned respectively with the two corresponding ones of the holding tubes 611 in the transverse direction. Each of the end portions 621 of the U-shaped rod 62 of each of the extension frames 6 is formed with an inner thread 623 extending in the transverse direction. Each of the bolts 64 extends frontwardly through a respective one of the end portions 631 of a respective one of the stopping bars 63, and engages threadedly the inner thread 623 in a respective one of the end portions 621 of the U-shaped rod 62 of a respective one of the extension frames 6 so as to hold the extension frames 6 on the supporting frame 30.

The U-shaped rod 62 of each of the extension frames 6 further has a bight portion 622 that is transverse to the end portions 621 of the U-shaped rod 62 and that is aligned with the respective one of the stopping bars 63 in the transverse direction. The swing frame unit 3 further includes a flexible web 65 extending between and supported on the bight portion 622 of the U-shaped rod 62 of a respective one of the extension frames 6 and a respective one of the stopping bars 63.

A retaining unit 5 includes a pair of retaining members 51 secured to the rear rod 33 of the supporting frame 30. A U-shaped supporting leg 52 is pivoted to the backrest frame 42, and engages releasaably the retaining members 51 for retaining the backrest frame 42 at the inclined position. The supporting leg 52 contacts the ground when the backrest frame 42 is disposed at the horizontal position.

Figure 9:
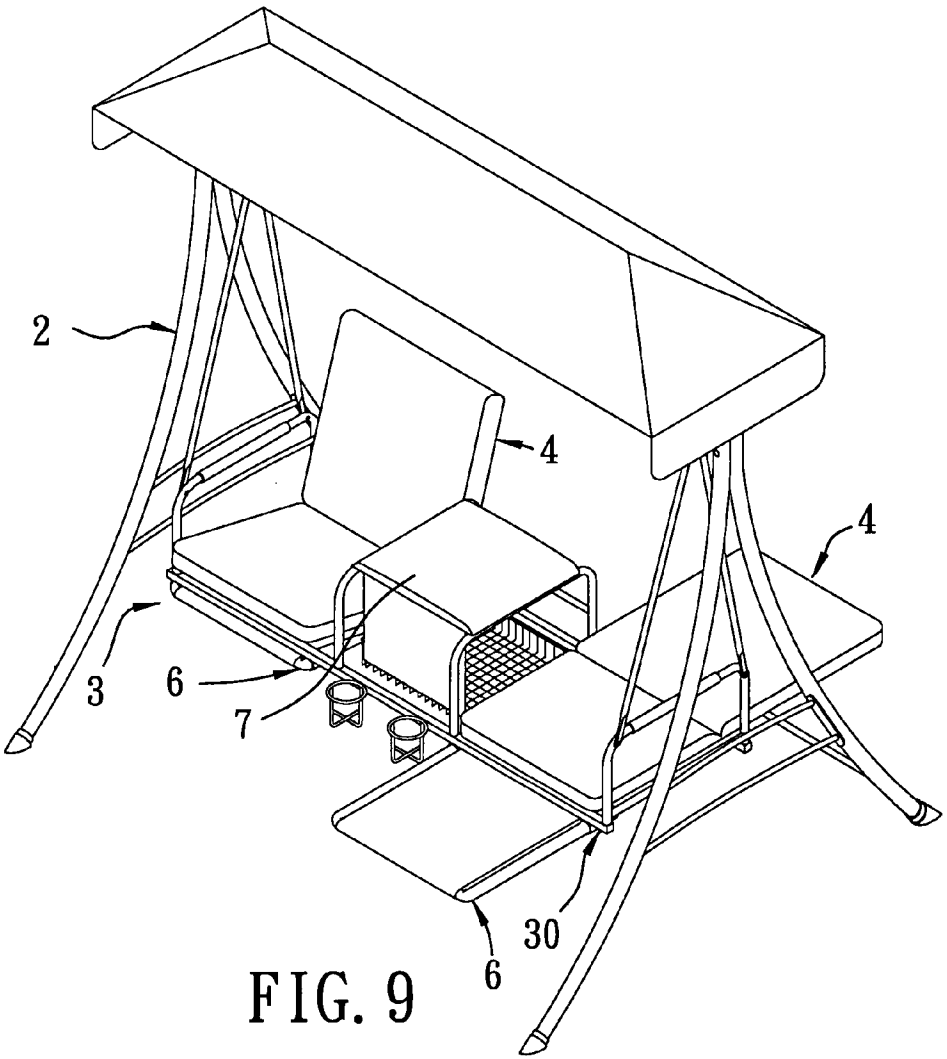
FIG. 9 is a perspective view of the second preferred embodiment of the swing according to this invention.

FIG. 9 illustrates the second preferred embodiment of the swing according to this invention. The swing of this embodiment differs from the previous embodiment in that the swing frame unit 3 includes two chairs 4 and a table 7 disposed between the chairs 4. The chairs 4 and the table 7 are mounted on the supporting frame 30. Each of the extension frames 6 is disposed movably underneath a respective one of the chairs 4.

With the inclusion of the extension frame(s) 6 in the swing of this invention, the aforesaid drawback associated with the prior art can be eliminated.

With the invention thus explained, it is apparent that various modifications and variations can be made without departing from the spirit of the present invention. It is therefore intended that the invention be limited only as recited in the appended claims.

I claim:

1. A swing comprising:

a swing-supporting unit, and a swing frame unit supported swingably on said swing-supporting unit and including a supporting frame having a front edge and a bottom side, a seat frame disposed on said supporting frame, a backrest frame pivoted to said supporting frame and pivotable about an axis between a horizontal position and an inclined position relative to said seat frame, and an extension frame mounted movably on said bottom side of said supporting frame and movable in a transverse direction relative to said front edge of said supporting frame from a retracted position to an extended position, in which said extension frame extends outwardly of said front edge of said supporting frame in said transverse direction so as to increase an overall length of said backrest frame, said seat frame, and said extension frame in said transverse direction, wherein said supporting frame includes an elongated rod that defines said front edge of said supporting frame and that is formed with a pair of holding tubes at said bottom side of said supporting frame, said holding tubes extending in said transverse direction, said extension frame including a U-shaped rod that has two opposite end portions extending respectively through said holding tubes in said transverse direction so as to be mounted movably on said supporting frame.

2. The swing of claim 1, wherein said swing frame unit further includes an extension-mounting unit that has a pair of bolts and a stopping bar disposed rearwardly of said holding tubes and having two opposite end portions which are aligned respectively with said holding tubes in said transverse direction, each of said end portions of said U-shaped rod being formed with an inner thread extending in said transverse direction, said bolts extending frontwardly through said end portions of said stopping bar and engaging threadedly and respectively said inner threads in said end portions of said U-shaped rod so as to hold said extension frame on said supporting frame.

3. The swing of claim 2, wherein said U-shaped rod further has a bight portion that is transverse to said end portions of said U-shaped rod and that is aligned with said stopping bar in said transverse direction, said swing frame unit further including a flexible web extending between and supported on said bight portion of said U-shaped rod and said stopping bar.

* * * * *